US011541504B2

(12) United States Patent
Ahn et al.

(10) Patent No.: US 11,541,504 B2
(45) Date of Patent: Jan. 3, 2023

(54) RECYCLED POLISHING PAD

(71) Applicants: Samsung Electronics Co., Ltd., Suwon-si (KR); FNS Tech Co., Ltd., Cheonan-si (KR)

(72) Inventors: Bong Su Ahn, Hwaseong-si (KR); Pal Kon Kim, Cheonan-si (KR); Young Jun Yoo, Cheonan-si (KR); Si Hyeong Kim, Hwaseong-si (KR); Yoon Ho Kim, Hwaseong-si (KR); Jin Ok Moon, Hwaseong-si (KR); Seung Taek Oh, Cheonan-si (KR)

(73) Assignees: Samsung Electronics Co., Ltd.; FNS TECH CO., LTD.

( * ) Notice: Subject to any disclaimer, the term of this patent is extended or adjusted under 35 U.S.C. 154(b) by 769 days.

(21) Appl. No.: 16/456,904

(22) Filed: Jun. 28, 2019

(65) Prior Publication Data

US 2020/0238472 A1 Jul. 30, 2020

(30) Foreign Application Priority Data

Jan. 29, 2019 (KR) ..... 10-2019-0011257

(51) Int. Cl.
*B24B 37/20* (2012.01)

(52) U.S. Cl.
CPC ..... *B24B 37/205* (2013.01)

(58) Field of Classification Search
CPC ..... B24B 37/20; B24B 37/22; B24B 37/26; B24D 11/02; B24D 3/001; B24D 3/002
See application file for complete search history.

(56) References Cited

U.S. PATENT DOCUMENTS 6,244,941 B1 * 6/2001 Bowman ..... B24D 9/08 451/287
6,540,597 B1 4/2003 Ohmori
7,156,722 B2 * 1/2007 Min ..... B24B 37/16 451/287
7,329,170 B2 * 2/2008 Ono ..... B24D 11/008 451/526
8,066,552 B2 * 11/2011 Duboust ..... B24B 37/26 451/527
8,702,474 B2 4/2014 Suzuki et al.
8,702,477 B2 4/2014 Suzuki et al.
8,992,288 B2 * 3/2015 Suzuki ..... B24B 37/22 451/285
9,017,140 B2 4/2015 Allison et al.
(Continued)

FOREIGN PATENT DOCUMENTS

JP 2010214579 9/2010
JP 2014054719 3/2014
(Continued)

*Primary Examiner* — Joel D Crandall
(74) *Attorney, Agent, or Firm* — Myers Bigel, P.A.

(57) ABSTRACT

A recycled polishing pad includes an upper layer pad and a supplementary pad. The upper layer pad includes a first surface and a second surface opposite to the first surface. The first surface has a plurality of first grooves and the second surface has a plurality of second grooves. The upper layer pad further includes a connecting body connecting the first grooves and the second grooves. The supplementary pad is in contact with the second surface of the upper layer pad. A depth of each of the first grooves is less than a depth of each of the second grooves.

20 Claims, 12 Drawing Sheets

(56) References Cited

U.S. PATENT DOCUMENTS

| | | | | |
|---|---|---|---|---|
| 9,993,907 | B2 | 6/2018 | Murugesh et al. | |
| 2001/0031612 | A1* | 10/2001 | Scott | B24B 37/16 451/65 |
| 2004/0198056 | A1* | 10/2004 | Suzuki | B24B 37/26 438/692 |
| 2006/0014476 | A1* | 1/2006 | Birang | G01B 11/0683 451/6 |
| 2008/0305720 | A1* | 12/2008 | Hirose | B24D 18/00 51/297 |
| 2009/0124176 | A1* | 5/2009 | Borucki | B24B 37/20 451/286 |
| 2010/0012269 | A1* | 1/2010 | Jensen | B24B 37/22 156/289 |
| 2014/0024299 | A1* | 1/2014 | Tu | B24B 37/26 451/282 |
| 2015/0004886 | A1* | 1/2015 | Hamaura | B24B 47/22 451/526 |
| 2015/0336236 | A1* | 11/2015 | Chen | B23K 26/36 438/692 |
| 2018/0001441 | A1* | 1/2018 | Ang | B24D 13/20 |

FOREIGN PATENT DOCUMENTS

| | | |
|---|---|---|
| KR | 20110090844 | 8/2011 |
| KR | 101233239 | 2/2013 |
| KR | 101755282 | 7/2017 |

* cited by examiner

RECYCLED POLISHING PAD

CROSS-REFERENCE TO RELATED APPLICATION

This application claims priority from Korean Patent Application No. 10-2019-0011257, filed on Jan. 29, 2019, the disclosure of which is incorporated herein by reference in its entirety.

BACKGROUND

Example embodiments of the inventive concept relate to a recycled polishing pad.

In the manufacturing of integrated circuit devices, a chemical mechanical polishing (CMP) process is being used to ensure a degree of global planarization required on a surface of a substrate such as a semiconductor wafer, glass, or the like, and on surfaces of various films formed on the substrate. A polishing pad used in a CMP process comes into contact with a substrate in a state of being attached onto a polishing platen to planarize an uneven portion of a surface of the substrate. The polishing pad is a consumable part by which the flatness of the substrate is highly influenced. However, the polishing pad is currently being treated as industrial waste after it has been used once. Therefore, in order to reduce costs and reduce environmental contamination, it is desirable to recycle/reuse a used polishing pad.

SUMMARY

The example embodiments of the inventive concept are directed to providing a method of efficiently recycling a used polishing pad, and a polishing pad recycled by the method.

According to example embodiments, there is provided a recycled polishing pad which includes an upper layer pad including a first surface having a plurality of first grooves, a second surface having a plurality of second grooves and being opposite to the first surface, and a connecting body connecting the plurality of first grooves and the plurality of second grooves and a supplementary pad contacting the first surface of the upper layer pad. A depth of each of the plurality of first grooves is reduced by a predetermined level from an initial depth and is less than a depth of each of the plurality of second grooves, and the supplementary pad has a thickness corresponding to the predetermined level.

According to example embodiments, there is provided a recycled polishing pad which includes an upper layer pad including a first surface having a plurality of first grooves, a second surface having a plurality of second grooves and being opposite to the first surface, and a connecting body connecting the first surface and the second surface and a supplementary pad in contact with the first surface of the upper layer pad. A depth of each of the plurality of first grooves is reduced by a predetermined level from an initial depth and is less than a depth of each of the plurality of second grooves, and the plurality of first grooves and the plurality of second grooves have a round shape. The supplementary pad has a thickness corresponding to the predetermined level.

According to example embodiments, there is provided a recycled polishing pad which includes an upper layer pad including a first surface having a plurality of first grooves, a second surface having a plurality of second grooves and being opposite to the first surface, and a connecting body connecting the plurality of first grooves and the plurality of second grooves, a supplementary pad below the upper layer pad and in contact with the first surface, and a lower layer pad below the supplementary pad. A depth of each of the first grooves is reduced by a predetermined level from an initial depth and is less than a depth of each of the second grooves, and the supplementary pad has a thickness corresponding to the predetermined level.

DETAILED DESCRIPTION OF EXEMPLARY EMBODIMENTS

Figure 1:
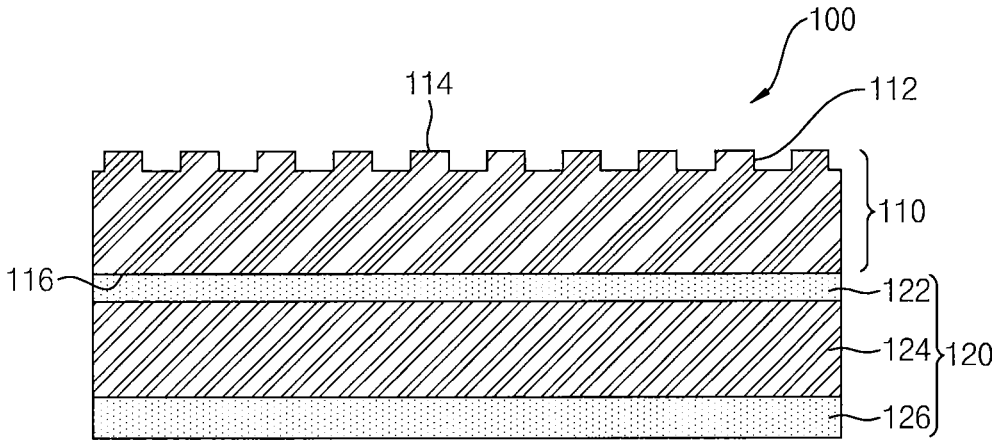
FIG. 1 is a cross-sectional view showing a portion of a worn polishing pad which is used to manufacture a recycled polishing pad according to an example embodiment of the inventive concept.

FIG. 1 is a cross-sectional view showing a portion of a worn polishing pad 100 which is used to manufacture a recycled polishing pad according to an example embodiment of the inventive concept. The worn polishing pad 100 is a polishing pad before being recycled that has a worn polishing surface because the worn polishing pad 100 has been used during a polishing process.

The worn polishing pad 100 includes an upper layer pad 110. The upper layer pad 110 includes a polishing surface 114 having a plurality of first grooves 112 and includes a bottom surface 116 opposite to the polishing surface 114. The first grooves 112 support a large flow of slurry on a surface of the polishing pad 100. The first grooves 112 may have a depth reduced by a predetermined level from an initial depth (e.g., about 0.8 mm to about 1.0 mm) after a polishing process (e.g., a chemical mechanical polishing process) is performed therewith. For example, the depth of the grooves included in the worn polishing pad may be about 0.2 mm, but the inventive concept is not limited thereto. For example, the upper layer pad 110 may be made of or include a porous polyurethane material and may include pores which support a fine flow, but the inventive concept is not limited thereto.

In some example embodiments, the worn polishing pad 100 may further include a support layer 120. The support layer 120 may include a first adhesive layer 122, a lower layer pad 124, and a second adhesive layer 126. The lower layer pad 124 may be made of a material having stability with respect to a force for pressing a substrate and may uniformly support the upper layer pad 110 by buffering the force. Examples of the lower layer pad 124 may include a lower layer pad formed of or including polyurethane foam, a lower layer pad formed of or including impregnated felt, a lower layer pad formed of or including microporous polyurethane, a lower layer pad formed of or including sintered urethane, and a lower layer pad formed of or including polyolefin foam. The lower layer pad 124 may have hardness which is lower than hardness of the upper layer pad 110. In addition, the lower layer pad 124 may have compressibility that is higher than compressibility of the upper layer pad 110.

The first adhesive layer 122 may be provided between the upper layer pad 110 and the lower layer pad 124 so as to attach the lower layer pad 124 to the upper layer pad 110. The second adhesive layer 126 may be provided between the lower layer pad 124 and a plate or platen of a polishing apparatus so as to fix the polishing pad 100 to the polishing apparatus. The first adhesive layer 122 and the second adhesive layer 126 may include a pressure sensitive adhesive (PSA) or a hot melt adhesive (HMA). For example, the PSA may be an adhesive containing a polyacrylic component, an epoxy component, a rubber component, or the like or may be a double-sided pressure-sensitive adhesive tape in which an adhesive material is applied to two sides of a substrate (e.g., a polyethylene terephthalate (PET) film or a felt), but the inventive concept is not limited thereto. For example, the HMA may be a cured reactive hot melt adhesive, but the inventive concept is not limited thereto.

In the example embodiments disclosed herein, the case in which the first adhesive layer 122 or the second adhesive layer 126 is used as an attachment part between the upper layer pad 110 and the lower layer pad 124 or between the polishing pad 100 and the platen is illustrated, but the inventive concept is not limited thereto. In various example embodiments, any appropriate method (e.g., welding, snap-fastening, etc.) may also be used for the attachment part.

Figure 2:
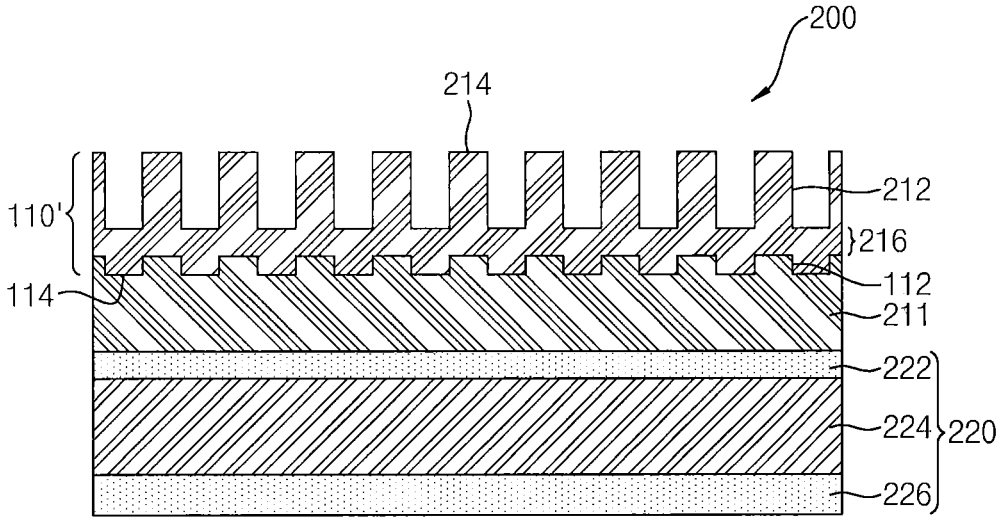
FIG. 2 is a cross-sectional view showing a portion of a recycled polishing pad according to an example embodiment of the inventive concept.

FIG. 2 is a cross-sectional view showing a portion of a recycled polishing pad 200 according to an example embodiment of the inventive concept.

The recycled polishing pad 200 includes an upper layer pad 110' and a supplemental pad or supplementary pad 211. The upper layer pad 110' is a pad obtained by reprocessing/recycling the upper layer pad 110 of the worn polishing pad 100 shown in FIG. 1. The upper layer pad 110' includes a first surface 114 having a plurality of first grooves 112, a second surface 214 having a plurality of second grooves 212, and a connecting body 216 which connects the first grooves 112 to the second grooves 212. The connecting body 216 may extend between the first grooves 112 or the first surface 114 and the second grooves 212 or the second surface 214. The first grooves 112 may be disposed in one side of the connecting body 216 and the second grooves 212 may be disposed in the other side of the connecting body 216. The second surface 214 is opposite the first surface 114. The first surface 114 of the upper layer pad 110' is identical to the polishing surface 114 of the worn polishing pad 100 of FIG. 1 and the second surface 214 of the upper layer pad 110' constitutes a new polishing surface of the recycled polishing pad 200.

According to the example embodiment, the first grooves 112 may be identical to the first grooves 112 of the worn polishing pad 100 of FIG. 1 and a depth of each of the first grooves 112 may be reduced by a predetermined level from an initial depth (e.g., about 0.8 mm to about 1.0 mm) Hereinafter, the predetermined level reduced from the initial depth may be referred to as "a depth reduction level." According to the example embodiment, the second grooves 212 are newly formed grooves in the upper layer pad 110 of FIG. 1. The depth of each of the first grooves 112 may be less than a depth of each of the second grooves 212. The first grooves 112 and the second grooves 212 may have a rectangular shape. For example, side surfaces of the first grooves 112 and side surfaces of the second grooves 212 may be substantially perpendicular to the first surface 114 and the second surface 214, respectively, and bottom surfaces of the first grooves 112 and bottom surfaces of the second grooves 212 may be formed parallel to the first surface 114 and the second surface 214, respectively. In FIG. 2, the first grooves 112 and the second grooves 212 may be formed to be misaligned or staggered, but in some example embodiments, the first grooves 112 and the second grooves 212 may be formed to be substantially aligned with each other. In addition, the second grooves 212 may be formed with a pattern different from that of the first grooves 112. For example, widths of and an interval between the first grooves 112 may be different from widths of and an interval between the second grooves 212.

In some example embodiments, the supplementary pad 211 is formed in contact with the first surface 114. The supplementary pad 211 may fill inner sides or volumes of the first grooves 112 of the first surface 114. The supplementary pad 211 is directly bonded to the first surface 114 of the upper layer pad 110'. The expression "directly bonded" means that one pad comes into direct contact with another pad without any intermediate layer (e.g., a PSA). For example, the supplementary pad 211 may be formed by injecting and molding the supplementary pad 211 composition on the first surface 114 in a mold. In some example embodiments, the supplementary pad 211 may be made of an identical or similar material to a material of the upper layer pad 110'. For example, the supplementary pad 211 composition may include a urethane-based prepolymer, a curing agent, and a solid foaming agent. In some example embodiments, the supplementary pad 211 may be made of a material different from the material of the upper layer pad 110'.

In some example embodiments, the supplementary pad 211 may be formed to have a thickness corresponding to the depth reduction level of the first grooves 112. As the polishing process proceeds, the polishing surface of the polishing pad 100 wears and the depth of each of the grooves is gradually reduced from the initial depth. The supplementary pad 211 may be formed to supplement a reduced thickness of the polishing pad 100. In some example embodiments, the supplementary pad 211 may be formed such that a total thickness of the worn upper layer pad 110' and the supplementary pad 211 is at least equal to or is at least substantially equal to the thickness of the upper layer pad 110 before use.

In some example embodiments, the recycled polishing pad 200 may further include a support layer 220. The support layer 220 may include a first adhesive layer 222, a lower layer pad 224, and a second adhesive layer 226. The first adhesive layer 222, the lower layer pad 224, and the second adhesive layer 226 correspond to the first adhesive layer 122, the lower layer pad 124, and the second adhesive layer 126 included in the support layer 120 of FIG. 1, respectively.

Figure 3:
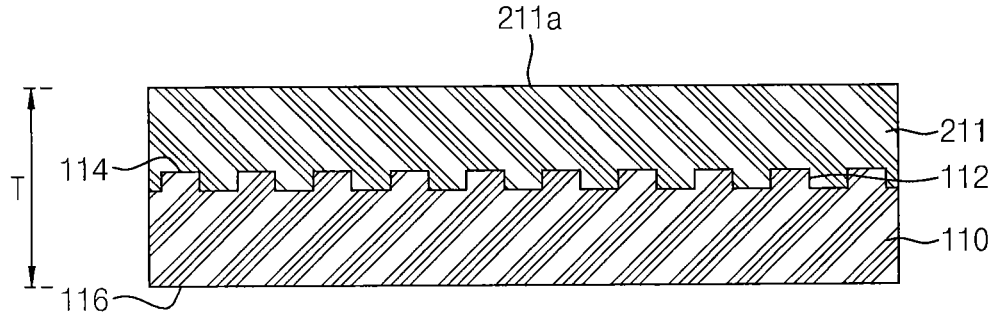
FIGS. 3 and 4 are cross-sectional views for describing a method of recycling a polishing pad according to an example embodiment of the inventive concept.
Figure 4:
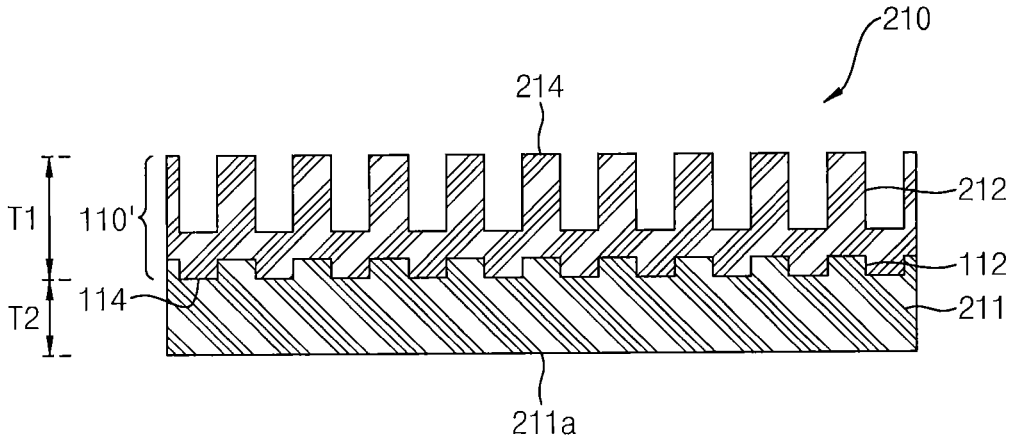

Hereinafter, a method of recycling a worn polishing pad to generate a polishing pad 200, which is the same as that in the example embodiment of FIG. 2, will be described with reference to FIGS. 3 and 4. FIGS. 3 and 4 are cross-sectional views for describing a method of recycling a polishing pad according to an example embodiment of the inventive concept.

Referring to FIG. 3, a supplementary pad 211 is formed on an upper layer pad 110 of a worn polishing pad (e.g., the polishing pad 100 of FIG. 1). In some example embodiments, the supplementary pad 211 is formed on a first surface 114 of the upper layer pad 110 having a plurality of first grooves 112. In example embodiments in which the plurality of first grooves 112 have a depth reduced by a predetermined depth reduction level, the supplementary pad 211 is formed to have a thickness corresponding to the predetermined depth reduction level. For example, the supplementary pad 211 may be formed such that a total thickness T of the worn upper layer pad 110 and the supplementary pad 211 is at least equal to or is at least substantially equal to a thickness of the upper layer pad 110 of the polishing pad 100 before use, in consideration of a working range of the thickness of the polishing pad 100. For example, the total thickness T of the supplementary pad 211 and the upper layer pad 110 may range from about 1 mm to about 3 mm, but the inventive concept is not limited thereto. In some example embodiments, a surface 211*a* such as a top surface of the supplementary pad 211 may be cut or sliced such that a thickness of the supplementary pad 211 is adjusted to have a desired thickness.

According to some example embodiments, the upper layer pad 110 before being recycled is disposed in a base of a mold. In some example embodiments, a supplementary pad 211 composition is injected toward a polishing surface of the upper layer pad 110 which is located in or on the upper layer pad 110. Thereafter, the injected supplementary pad 211 composition may be cured to form the supplementary pad 211. In some example embodiments, the supplementary pad 211 composition includes a urethane-based prepolymer, a curing agent, and a solid foaming agent. An isocyanate compound may be used to prepare the urethane-based prepolymer. The curing agent may include one or more compounds of an amine compound and an alcohol compound. For example, the curing agent may include one or more compounds selected from the group consisting of an aromatic amine, an aliphatic amine, an aromatic alcohol, and an aliphatic alcohol. The solid foaming agent may be a thermally expanded microcapsule and may be a microballoon structure having an average particle size of about 5 μm to about 200 μm. In some example embodiments, the average particle size of the solid foaming agent may range from about 10 μm to about 60 μm. In some example embodiments, the average particle size of the solid foaming agent may range from about 25 μm to about 45 μm.

In some example embodiments, the urethane-based prepolymer and the curing agent are mixed and then react with each other to form a solid polyurethane, which is manufactured as a sheet or the like. An isocyanate terminal group of the urethane-based prepolymer may react with an amine group, an alcohol group, or the like of the curing agent. In this case, the solid foaming agent may be uniformly dispersed in a source material to form pores without participating in the reaction of the urethane-based prepolymer and the curing agent. The reaction of the urethane-based prepolymer and the curing agent is completed in the mold so that a structure in which the upper layer pad 110 and the supplementary pad 211 are bonded may be obtained, as shown in FIG. 3. According to some example embodiments, a combination of the upper layer pad 110 and the supplementary pad 211 may be a molding product in the form of cake solidified along the shape of the mold. The combination of the upper layer pad 110 and the supplementary pad 211 may be processed as a sheet or the like for manufacturing a polishing pad by appropriately slicing or cutting the supplementary pad portion.

In some example embodiments, an inert gas may also be injected when the supplementary pad 211 composition is injected into the mold. The inert gas may form pores of the supplementary pad 211 in the process of mixing and reaction of the urethane-based prepolymer, the curing agent, and the solid foaming agent. For example, the inert gas may include one or more gases selected from the group consisting of nitrogen gas, argon gas, and helium gas, but the inventive concept is not limited thereto, and the inert gas may be any gas that does not participate in the reaction of the supplementary pad 211 composition.

Referring again to FIG. 3, the supplementary pad 211 may be directly formed on the first surface 114 of the upper layer pad 110. In some example embodiments, atoms of a material of the supplementary pad 211 may be cross-linked bonded to atoms of a material of the upper layer pad 110 or may share electrons with the atoms of the material of the upper layer pad 110 so that the atoms of the material of the supplementary pad 211 and the atoms of the material of the upper layer pad 110 may be covalently bonded along the first surface 114. The above-described bond is distinguished from a mechanical bond, such as an integrated bond using screws, nails, glue, or another adhesive. In some example embodiments, the supplementary pad 211 may be electrostatically bonded (e.g., Van der Waals interactions) along the first surface 114 of the upper layer pad 110, instead of being covalently bonded.

According to some example embodiments, when the worn polishing pad 100 of FIG. 1 includes a support layer 120, the support layer 120 is removed from a bottom surface 116 of the upper layer pad 110 before the supplementary pad 211 described in FIG. 3 is formed. Any suitable polymer removal method may be used to remove the support layer 120. For example, a physical method such as milling or a chemical method using a solvent such as toluene may be used to remove the support layer 120. In some example embodiments, after the support layer 120 is removed, the bottom surface 116 of the used upper layer pad 110 may be cleaned.

According to some example embodiments, the cleaning may also be performed on the first grooves 112 of the upper layer pad 110 before the supplementary pad 211 is formed. The cleaning may prevent loss of the first surface 114 between the upper layer pad 110 and the supplementary pad 211, which may be caused by foreign matter present between the grooves. The cleaning may be performed using a physical method, a dry method, a wet method, or a chemical method. For example, the physical method includes brush scrubbing and the like, the dry method includes air blowing, tornado cleaning, plasma cleaning, and the like, the wet method includes water jetting, stream jetting, bubble water jetting, ultrasonic cleaning, megasonic cleaning, and the like, and the chemical method includes dilute hydrofluoric acid (HF) cleaning, buffered oxide etch (BOE) cleaning, sulfuric acid peroxide mixture (SPM) cleaning, ammonium peroxide mixture (APM) cleaning, hydrochloric peroxide mixture (HPM) cleaning, and the like, but the inventive concept is not limited thereto.

Referring to FIGS. 3 and 4, second grooves 212, which are a plurality of new grooves, are formed in the bottom surface 116 of the upper layer pad 110, which is opposite the first surface 114 of the worn upper layer pad 110. In some example embodiments, the second grooves 212 may be formed on the bottom surface 116 of the upper layer pad 110 in a state in which the structure of FIG. 3 is turned upside down. For example, when a total thickness T of the supplementary pad 211 and the upper layer pad 110 is about 2 mm, the second grooves 212 may have a depth of about 0.8 mm to about 1.0 mm from the bottom surface 116, but the inventive concept is not limited thereto. In some example embodiments, the second grooves 212 may have the same depth or different depths.

A thickness ratio T1:T2 of the reprocessed or recycled upper layer pad 110' to the supplementary pad 211 may range from about 4:4 to about 7:1, about 4:4 to about 6:2, or about 4:4 to about 5:3. For example, a thickness T1 of the upper layer pad 110' may be defined as a distance from a protruding surface of the second surface 214 to a protruding surface of the first surface 114. For example, a thickness T2 of the supplementary pad 211 may be defined as a distance from the protruding surface of the first surface 114 to the surface 211*a* of the supplementary pad 211 opposite to the first surface 114. However, the thickness ratio T1:T2 is not limited thereto and may be any appropriate ratio according to a degree of wear of the upper layer pad 110 of the worn polishing pad 100.

According to some example embodiments, after the second grooves 212 are formed, a lower layer pad (e.g., the lower layer pad 224 of FIG. 2) may be further attached to the surface 211*a* of the supplementary pad 211 opposite to the first surface 114. For example, the lower layer pad 224 may be attached to the supplementary pad 211 using an adhesive (e.g., the first adhesive layer 222 of FIG. 2).

Figure 5:
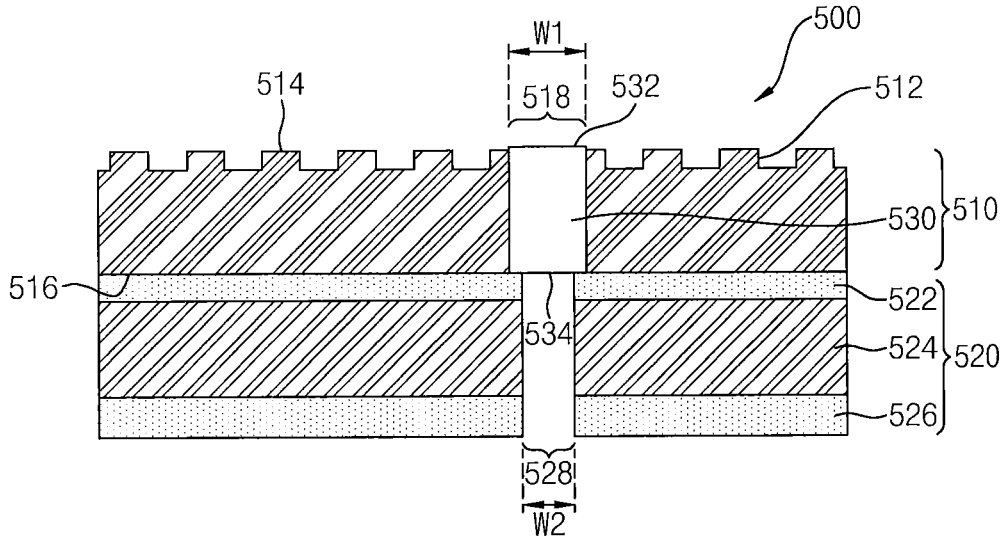
FIG. 5 is a cross-sectional view showing a portion of a worn polishing pad including a window which is used to manufacture a recycled polishing pad according to an example embodiment of the inventive concept.

FIG. 5 is a cross-sectional view showing a portion of a worn polishing pad 500 including a window 530 which is used to manufacture a recycled polishing pad according to an example embodiment of the inventive concept.

In some example embodiments, in order to detect a polishing endpoint during a polishing process, the polishing pad 500 may further include the window 530 disposed in an upper layer pad 510, as in the example embodiment of FIG. 5. The window 530 may be accommodated in an opening 518 of the upper layer pad 510. The window 530 may have a width W1 and may extend to pass through the upper layer pad 510.

The window 530 may be a light-transmitting or transparent layer disposed at a position at which visibility of a substrate may be secured regardless of a position of translational motion of the polishing pad 500. For example, while the window 530 is adjacent to the substrate, a light beam is projected toward the substrate through the window 530 by a light source for determining the polishing endpoint. A polishing endpoint detector may be used to receive light reflected from the substrate and detect the polishing endpoint. For example, the polishing endpoint detector may determine the polishing endpoint by detecting a sudden change in the substrate reflectance that implies exposure of a new layer using the measured intensity of the reflected light or by calculating a thickness of the substrate removed from an outer layer (e.g., a transparent oxide layer) using an interference measurement principle. In an example, the polishing endpoint detector may determine the polishing endpoint by monitoring a spectrum of the reflected light and detecting a target spectrum by matching the order of the measured spectrum with a reference spectrum from a library and determining a point at which a linear function that corresponds to an index value of the reference spectrum reaches a target value or by monitoring a signal for predetermined endpoint criterion. In some example embodiments, the light source and the polishing endpoint detector may be located inside the polishing apparatus.

According to the example embodiment shown in FIG. 5, the window 530 has substantially the same shape as the opening 518. In some example embodiments, the window 530 may have a circular shape, an elliptical shape, a square shape, a rectangular shape, or any other shape. A first surface 532 of the window 530 in addition to grooves 512 may also be worn during a polishing process. The first surface 532 of the window 530 may be substantially identical (e.g., coplanar) to a first surface 514 of the upper layer pad 510 adjacent thereto or may be concave or convex relative to the first surface 514 depending on a material of the window 530. According to the example embodiment, the first surface 514 of the upper layer pad 510 is a worn polishing surface of the upper layer pad 510.

In some example embodiments, the worn polishing pad 500 may further include a support layer 520. The support layer 520 may include a first adhesive layer 522, a lower layer pad 524, and a second adhesive layer 526. The first adhesive layer 522, the lower layer pad 524, and the second adhesive layer 526 correspond to the first adhesive layer 122, the lower layer pad 124, and the second adhesive layer 126 included in the support layer 120 of FIG. 1, respectively. According to the example embodiment shown in FIG. 5, the window 530 is fixed by the first adhesive layer 522. However, the inventive concept is not limited thereto, and the window 530 may be fixed by any appropriate method (e.g., welding, snap-fastening, etc.). An opening 528 is formed to pass through the support layer 520. A second surface 534 of the window 530 may be at least partially exposed through the opening 528. At least a portion of the second surface 534 of the window 530 may be in communication with the opening 528. In some example embodiments, a width W2 of the opening 528 may be less than the width W1 of the window 530.

FIGS. 6A and 6B, 7A to 7C, and 8A to 8C are cross-sectional views for describing a method of forming supplemental pads or supplementary pads 611*a* and 611*b* when the polishing pad 500 shown in FIG. 5 is recycled.

According to some example embodiments, a supplemental pad or supplementary pad may be formed on the first surface 514 of the upper layer pad 510 without removing the window 530 from the worn upper layer pad 510.

Figure 6A:
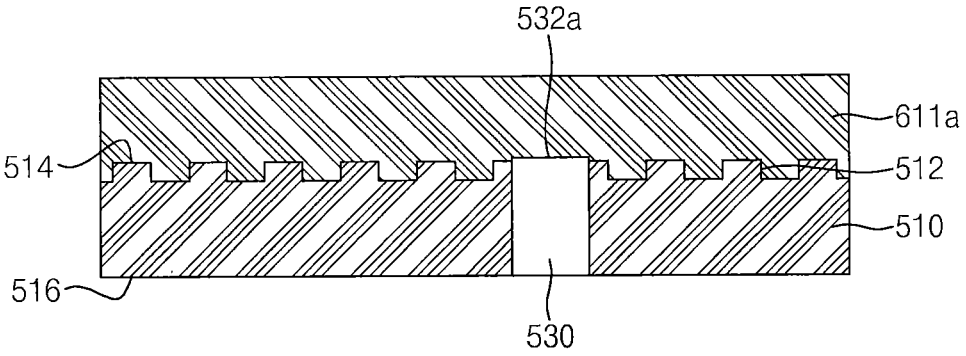
FIGS. 6A and 6B, 7A to 7C, and 8A to 8C are cross-sectional views for describing a method of forming supplementary pads when the polishing pad shown in FIG. 5 is recycled.

In the example embodiment of FIG. 6A, the supplementary pad 611*a* is formed on at least one surface 532*a* of the window 530 which was previously disposed in the upper layer pad 510 before being recycled. For example, the at least one surface 532*a* may include an upper surface of the window 530 or may include the upper surface of the window 530 and four side surfaces extending from the upper surface. The at least one surface 532*a* of the window 530 may form a continuous or substantially continuous surface with the first surface 514 of the upper layer pad 510. The supplementary pad 611*a* may come into direct contact with the at least one surface 532*a* of the window 530 which forms the continuous or substantially continuous surface with the first surface 514 of the upper layer pad 510. According to the example embodiment, the window 530 included in the polishing pad 500 before being recycled cannot function as the window 530 in the recycled polishing pad 500 as long as the supplementary pad 611*a* is made of an opaque material. New grooves may be formed on a bottom surface 516 of the upper layer pad 510, and a surface of the window 530 adjacent the bottom surface 516 may be appropriately processed to match with a newly formed polishing layer. The above-described method is applied to the following example embodiments.

Figure 6B:
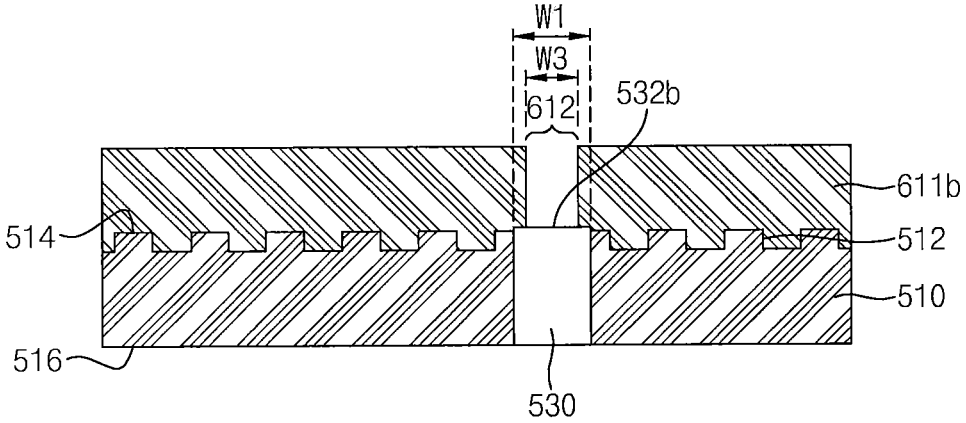

In the example embodiment of FIG. 6B, the supplementary pad 611*b* includes an opening 612 through which one surface 532*b* (e.g., the upper surface of the window 530) of the window 530, which was previously disposed in the upper layer pad 510 before being recycled, is at least partially exposed. At least a portion of the surface 532*b* of the window 530 may be in communication with the opening 612. As shown in FIG. 6B, the surface 532*b* of the window 530 may also form a continuous or substantially continuous surface with the first surface 514. In some example embodiments, a width W3 of the opening 612 may be less than or equal to the width W1 of the window 530. In some example embodiments, when the lower layer pad 524 is attached to the exposed surface (or the surface opposite to the first surface 514) of the supplementary pad 611*b* of FIG. 6B, the lower layer pad 524 is formed to expose at least a portion of the opening 612 of the supplementary pad 611*b*. For example, the opening 528 (FIG. 5) may be aligned with the opening 612. According to the example embodiment, light applied to detect a polishing endpoint may reach the substrate through the opening 612 and the window 530.

According to some example embodiments, the supplementary pad 611*b* may be formed on the first surface 514 of the upper layer pad 510 after the window 530 is removed from the used upper layer pad 510.

Figure 7A:
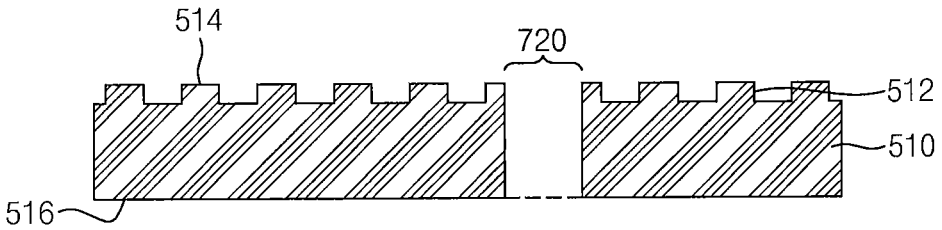
Figure 7B:
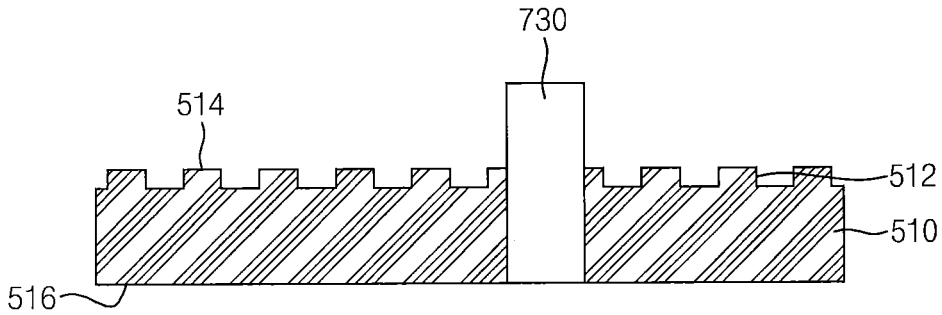
Figure 7C:
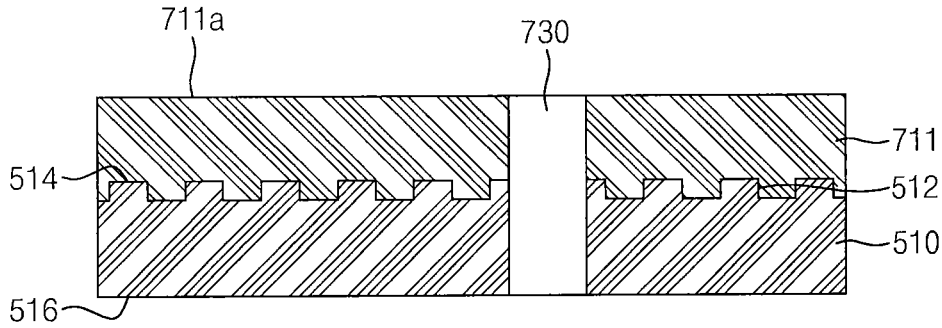

Referring to FIGS. 7A to 7C, the existing window 530 which was previously disposed in the upper layer pad 510 may be removed and a new window 730 may be located at a portion or space 720 in which the existing window 530 is removed. For example, a height of the new window 730 may be a distance at least from the bottom surface 516 of the upper layer pad 510 to a level at which a supplemental pad or supplementary pad 711 is formed. The supplementary pad 711 may be formed from the first surface 514 of the upper layer pad 510 to at least the end or height of the new window 730. For example, the worn upper layer pad 510 and the new window 730 may be located in the mold, as shown in FIG. 7B, and the supplementary pad 711 may be formed on the remaining portion of the first surface 514 excluding the new window 730. The new window 730 extends to pass through the upper layer pad 510 and the supplementary pad 711.

According to the example embodiment, the new window 730 is included in a polymer matrix which is used to form a pad structure of FIG. 7C so that the new window 730 is integrated with the pad structure. In some example embodiments, when the lower layer pad 524 is attached onto the exposed surface or top surface 711*a* (or the surface opposite to the first surface 514) of the supplementary pad 711 of FIG. 7C, the lower layer pad 524 is formed to expose at least a portion of the new window 730. For example, the lower layer pad 524 may be formed to expose a surface of the new window 730 which forms a continuous or substantially continuous surface (e.g., coplanar surface) with the surface 711*a* of the supplementary pad 711 opposite to the first surface 514. For example, the opening 528 (FIG. 5) may be aligned with the window 730.

Figure 8A:
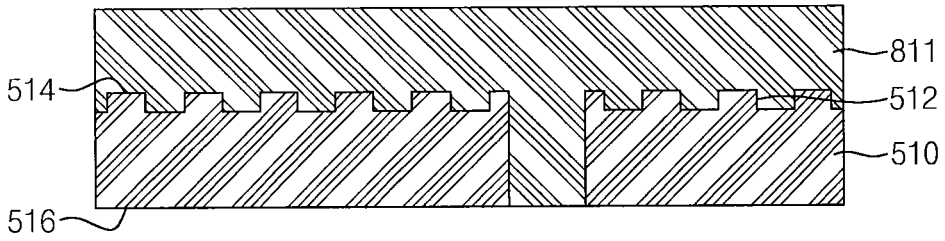
Figure 8B:
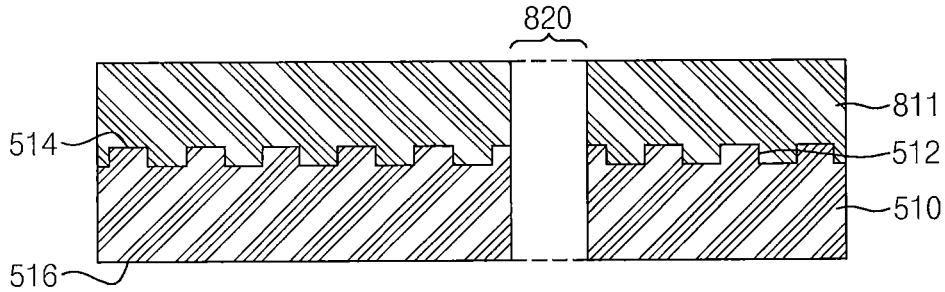
Figure 8C:
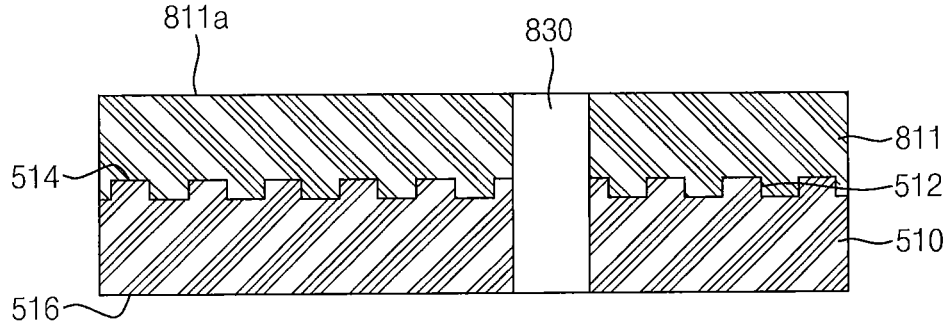

Referring to FIGS. 8A to 8C, in some example embodiments, a supplemental pad or supplementary pad 811 may be formed on the first surface 514 of the upper layer pad 510 while filling a portion or space (e.g., the portion 720 of FIG. 7A) in which the window 530, which was previously disposed in the upper layer pad 510, is removed. After an opening 820 passing through the upper layer pad 510 and the supplementary pad 811 is formed, a new window 830 may be inserted into the opening 820. For example, the inserted window 830 may have a height equal to or substantially equal to a total thickness of a pad structure of FIG. 8C. In some example embodiments, the lower layer pad 524 through which at least a portion of the new window 830 is exposed may also be attached onto the exposed surface of the supplementary pad 811 of FIG. 8C. For example, the opening 528 (FIG. 5) may be aligned with the window 830. For example, a surface of the new window 830 which forms a continuous or substantially continuous surface (e.g., coplanar surface) with a surface 811*a* of the supplementary pad 811 opposite to the first surface 514 may be exposed through the lower layer pad 524.

In some example embodiments, as shown in FIG. 8A, after the supplementary pad 811 is formed to fill the portion in which the existing window 530 is removed, the new window 830 may not be inserted. In this case, the supplementary pad 811 extends to pass through the upper layer pad 510. New grooves may be formed on the bottom surface 516 of the pad structure of FIG. 8A without the insertion of the new window 830 so that a windowless recycled polishing pad 500 may be generated.

The new windows 730 and 830 of FIGS. 7B, 7C, and 8C may be made of a material having high light transmittance. For example, the new windows 730 and 830 may be or include a polymeric resin having light transmittance of about 1% or more. The new windows 730 and 830 may be transparent.

Figure 9:
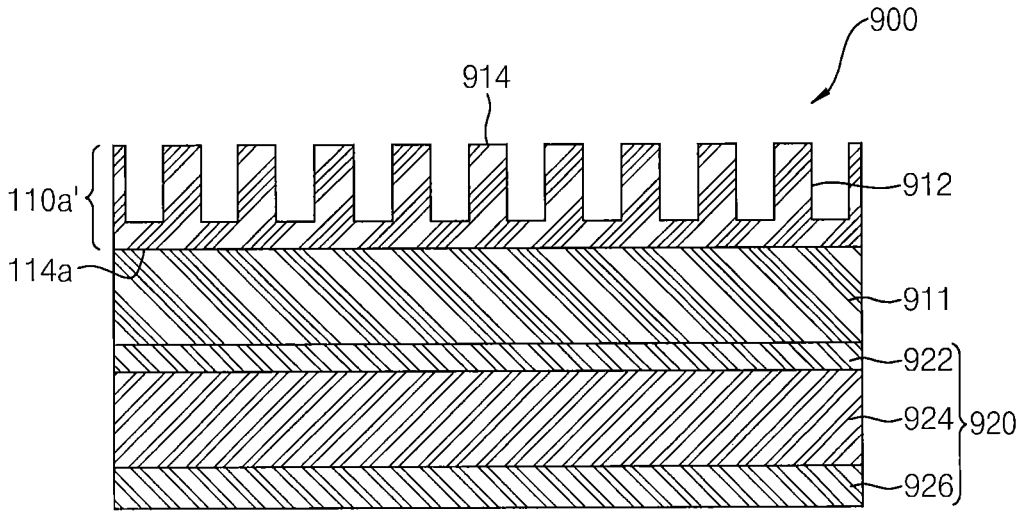
FIG. 9 is a cross-sectional view showing a portion of a recycled polishing pad according to an example embodiment of the inventive concept.

FIG. 9 is a cross-sectional view showing a portion of a recycled polishing pad 900 according to an example embodiment of the inventive concept.

The recycled polishing pad 900 includes an upper layer pad 110*a*' and a supplemental pad or supplementary pad 911. The upper layer pad 110*a*' is a pad obtained by reprocessing/recycling the upper layer pad 110 of the worn polishing pad 100 shown in FIG. 1. The upper layer pad 110*a*' includes a first surface 114*a* in contact with the supplementary pad 911 and a second surface 914 having a plurality of second grooves 912. The second surface 914 is opposite the first surface 114*a*. According to the example embodiment, the second grooves 912 are grooves newly formed in the worn upper layer pad 110 of FIG. 1 and constitute a new polishing surface of the recycled polishing pad 900.

In some example embodiments, the upper layer pad 110*a*' may be a result of forming the second grooves 912 after the first grooves 112 included in the upper layer pad 110 of the worn polishing pad 100 are removed. For example, the first grooves 112 may be removed by milling, but the inventive concept is not limited thereto. In some example embodiments, a first surface 114*a* of the upper layer pad 110*a*' may be the bottom surface 116 of the upper layer pad 110 of FIG. 1. In some example embodiments, the first surface 114*a* of the upper layer pad 110*a*' may be a surface in which the first grooves 112 of FIG. 1 are removed (e.g., the first surface 114*a* may be planar).

In some example embodiments, the supplementary pad 911 is formed in contact with the first surface 114*a*. The supplementary pad 911 is directly bonded to the first surface 114*a* of the upper layer pad 110*a*'. The expression "directly bonded" means that one pad comes into direct contact with another pad without any intermediate layer (e.g., a PSA).

For example, the supplementary pad 911 may be formed by injecting and molding the supplementary pad 911 composition on the first surface 114*a* in a mold. In some example embodiments, the supplementary pad 911 may be made of an identical or similar material to a material of the upper layer pad 110*a*'. For example, the supplementary pad 911 composition may include a urethane-based prepolymer, a curing agent, and a solid foaming agent. In some example embodiments, the supplementary pad 911 may be made of a material different from the material of the upper layer pad 110*a*'.

In some example embodiments, the recycled polishing pad 900 may further include a support layer 920. The support layer 920 may include a first adhesive layer 922, a lower layer pad 924, and a second adhesive layer 926. The first adhesive layer 922, the lower layer pad 924, and the second adhesive layer 926 correspond to the first adhesive layer 122, the lower layer pad 124, and the second adhesive layer 126 included in the support layer 120 of FIG. 1, respectively.

Figure 10:
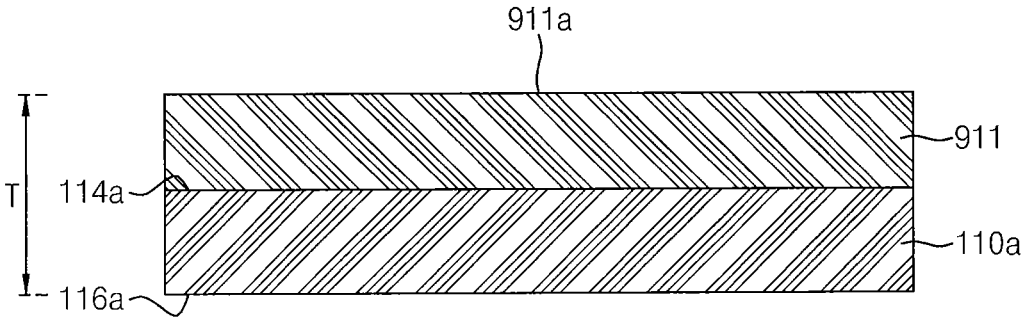
FIGS. 10 and 11 are cross-sectional views for describing a method of recycling a polishing pad according to an example embodiment of the inventive concept.
Figure 11:
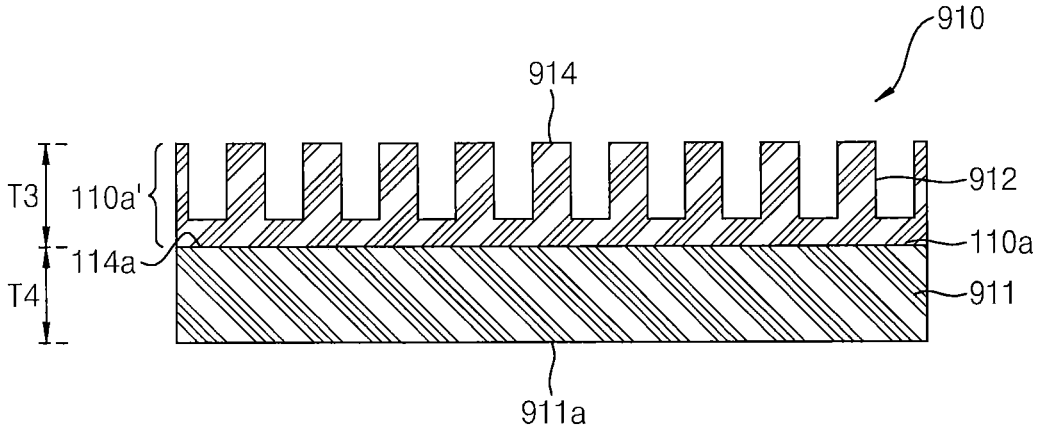

Hereinafter, a method of recycling a worn polishing pad to generate a polishing pad 900 which is the same as that in the example embodiment of FIG. 9 will be described with reference to FIGS. 10 and 11. FIGS. 10 and 11 are cross-sectional views for describing a method of recycling a polishing pad 900 according to an example embodiment of the inventive concept. The recycling method according to the example embodiments of FIGS. 10 and 11 is substantially the same as or similar to the recycling method according to the example embodiments of FIGS. 3 and 4 and further includes removing the grooves from the polishing pad before being recycled.

According to some example embodiments, the first grooves 112 are removed from the first surface 114 of the upper layer pad 110 having the plurality of first grooves 112 of FIG. 1. Referring to FIG. 10, in some example embodiments, a supplemental pad or supplementary pad 911 is formed on the upper layer pad 110*a* in which the first grooves 112 are removed. For example, the supplementary pad 911 may be formed on the bottom surface 116 of the upper layer pad 110 before being recycled of FIG. 1 or may be formed on a surface in which the first grooves 112 of FIG. 1 are removed. In the example embodiments in which the removed first grooves 112 have a depth reduced by a predetermined depth reduction level, the supplementary pad 911 is formed to have a thickness corresponding to a sum of the predetermined depth reduction level and the depth of each of the first grooves 112. In some example embodiments, the supplementary pad 911 may be formed such that a total thickness T of the upper layer pad 110*a*, in which the first grooves 112 are removed, and the supplementary pad 911 is at least equal to or at least substantially equal to the thickness of the upper layer pad of the polishing pad before use.

For example, the total thickness T of the supplementary pad 911 and the upper layer pad 110*a* may range from about 1 mm to about 3 mm, but the inventive concept is not limited thereto. In some example embodiments, a surface 911*a* of the supplementary pad 911 may be cut or sliced such that a thickness of the supplementary pad 911 is adjusted to have a desired thickness.

According to some example embodiments, the upper layer pad 110*a* is disposed in a base of a mold. In some example embodiments, the supplementary pad 911 composition is injected toward a surface 114*a*, which may be a planar surface, of the upper layer pad 110*a* which is located in the mold. Thereafter, the injected supplementary pad 911 composition may be cured to form the supplementary pad 911. In some example embodiments, the supplementary pad 911 composition includes a urethane-based prepolymer, a curing agent, and a solid foaming agent. A description thereof is identical to that described above with reference to FIG. 3.

According to some example embodiments, a combination of the upper layer pad 110*a* and the supplementary pad 911 may be a molding product in the form of cake solidified along the shape of the mold. The combination of the upper layer pad 110*a* and the supplementary pad 911 may be processed as a sheet or the like for manufacturing a polishing pad by appropriately slicing or cutting the supplementary pad portion.

In some example embodiments, an inert gas may also be injected when the supplementary pad 911 composition is injected into the mold. The inert gas may form pores of the supplementary pad 911 in the process of mixing and reaction of the urethane-based prepolymer, the curing agent, and the solid foaming agent. For example, the inert gas may include one or more gases selected from the group consisting of nitrogen gas, argon gas, and helium gas, but the inventive concept is not limited thereto, and the inert gas may be any gas that does not participate in the reaction of the supplementary pad 911 composition.

Referring again to FIG. 10, the supplementary pad 911 may be directly formed on the first surface 114*a* of the upper layer pad 110*a*. In some example embodiments, atoms of a material of the supplementary pad 911 may be cross-linked bonded to atoms of a material of the upper layer pad 110*a* or may share electrons with the atoms of the material of the upper layer pad 110*a* so that the atoms of the material of the supplementary pad 911 and the atoms of the material of the upper layer pad 110*a* may be covalently bonded along the first surface 114*a*. The above-described bond is distinguished from a mechanical bond, such as an integrated bond using screws, nails, glue, or other adhesive. In some example embodiments, the supplementary pad 911 may be electrostatically bonded (e.g., Van der Waals interactions) along the first surface 114*a* of the upper layer pad 110*a*, instead of being covalently bonded.

According to some example embodiments, when the worn polishing pad 100 of FIG. 1 includes a support layer 120, the support layer 120 is removed from a bottom surface 116 of the upper layer pad 110 before the first grooves 112 of the upper layer pad 110 of FIG. 1 are removed. Any suitable polymer removal method may be used to remove the support layer 120. For example, a physical method such as milling or a chemical method using a solvent such as toluene may be used to remove the support layer 120. In some example embodiments, after the support layer 120 is removed, the bottom surface 116 of the used upper layer pad 110 may be cleaned. According to some example embodiments, the cleaning may also be performed on the first surface 114*a* of the upper layer pad 110*a* in which the supplementary pad 911 will be formed before the first grooves 112 of the upper layer pad 110 are removed and the supplementary pad 911 is formed. The cleaning may prevent loss of the first surface 114*a* between the upper layer pad 110*a* and the supplementary pad 911, which may be caused by foreign matter.

Referring to FIGS. 10 and 11, second grooves 912, which are a plurality of new grooves, are formed in one surface 116*a* of the upper layer pad 110*a*, which is opposite the first surface 114*a* between the supplementary pad 911 and the upper layer pad 110*a*. In some example embodiments, the second grooves 912 may be formed in the surface 116*a* of the upper layer pad 110*a* in a state in which the structure of FIG. 10 is turned upside down. For example, when a total thickness T of the supplementary pad 911 and the upper layer pad 110*a* is about 2 mm, the second grooves 912 may have a depth of about 0.8 mm to about 1.0 mm from the surface 116*a*, but the inventive concept is not limited thereto. In some example embodiments, the second grooves 912 may have the same depth or different depths.

A thickness ratio T3:T4 of the reprocessed or recycled upper layer pad 110*a*' to the supplementary pad 911 may range from about 4:4 to about 1:7, about 4:4 to about 2:6, or about 4:4 to about 3:5. For example, a thickness T3 of the upper layer pad 110*a*' may be defined as a distance from a protruding surface of the second surface 914 to the first surface 114*a*. For example, a thickness T4 of the supplementary pad 911 may be defined as a distance from the first surface 114*a* to the surface 911*a* of the supplementary pad 911 opposite to the first surface 114*a*. However, the thickness ratio T3:T4 is not limited thereto and may be any appropriate ratio according to a degree of wear of the upper layer pad 110 of the worn polishing pad 100.

According to some example embodiments, after the second grooves 912 are formed, a lower layer pad (e.g., the lower layer pad 924 of FIG. 9) may be further attached to the surface 911*a* of the supplementary pad 911 opposite to the first surface 114*a*. For example, the lower layer pad may be attached to the supplementary pad 911 using an adhesive (e.g., the first adhesive layer 922 of FIG. 9).

In some example embodiments, the method of recycling the polishing pad described with reference to FIGS. 9 to 11 may also be applied to a polishing pad including a window in an upper layer pad. When the polishing pad before being recycled includes a window, a portion of the window may also be removed together with the first grooves 112 of the worn polishing pad 100 so that one surface of the window may be located at the same level or substantially the same level as the surface in which the first grooves 112 are removed.

FIGS. 12A and 12B, 13A to 13C, and 14A to 14C are cross-sectional views for describing a method of forming a supplemental pad or supplementary pad when a polishing pad including a window according to an example embodiment of the inventive concept is recycled. In FIGS. 12A and 12B, 13A to 13C, and 14A to 14C, upper layer pads 1210, 1310, and 1410 are in a state in which first grooves 112 are removed therefrom.

According to some example embodiments, a supplemental pad or supplementary pad may be formed on a surface of an upper layer pad without removing a window from the worn upper layer pad.

Figure 12A:
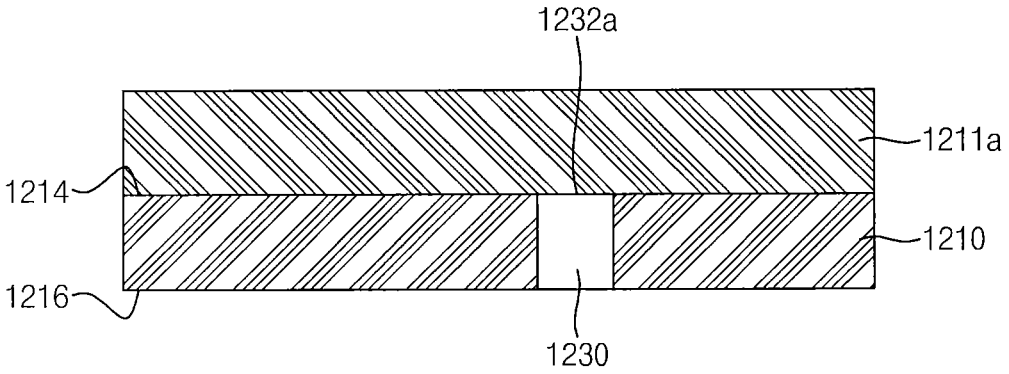
FIGS. 12A and 12B, 13A to 13C, and 14A to 14C are cross-sectional views for describing a method of forming a supplementary pad when a polishing pad including a window according to an example embodiment of the inventive concept is recycled.

In the example embodiment of FIG. 12A, a supplemental pad or supplementary pad 1211*a* is formed on an upper layer pad 1210 in which the first grooves 112 of the worn polishing pad 100 are removed and on one surface 1232*a* of a window 1230 which was previously disposed in the upper layer pad 1210 before being recycled. The surface 1232*a* of the window 1230 may form a continuous or substantially continuous surface with one surface 1214 of the upper layer pad 1210. The supplementary pad 1211*a* may come into direct contact with the surface 1232*a* of the window 1230 which forms the continuous or substantially continuous surface with the surface 1214 of the upper layer pad 1210. According to the example embodiment, the window 1230 included in the polishing pad 100 before being recycled cannot function as the window in the recycled polishing pad as long as the supplementary pad 1211*a* is made of an opaque material. New grooves may be formed in one surface 1216 of the upper layer pad 1210, which is opposite the surface 1214, and a surface of the window 1230 adjacent to the surface 1216 may be appropriately processed to match with a newly formed polishing layer.

Figure 12B:
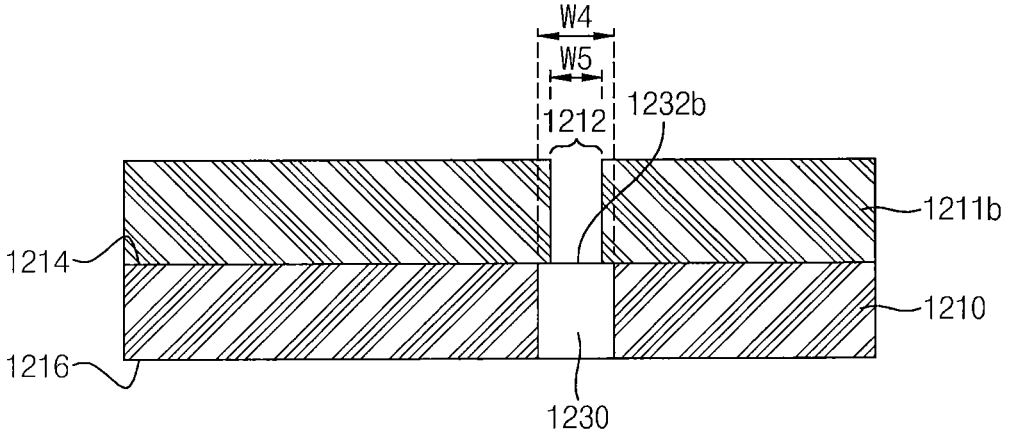

In the example embodiment of FIG. 12B, a supplemental pad or supplementary pad 1211*b* includes an opening 1212 through which one surface 1232*b* of the window 1230, which was previously disposed in the upper layer pad 1210 before being recycled, is at least partially exposed. At least a portion of the surface 1232*b* of the window 1230 may be in communication with the opening 1212. As shown in FIG. 12B, the surface 1232*b* of the window 1230 may also form a continuous or substantially continuous surface with the surface 1214 of the upper layer pad 1210. In some example embodiments, a width W5 of the opening 1212 may be less than or equal to a width W4 of the window 1230. In some example embodiments, when the lower layer pad is attached to the exposed surface (or the surface opposite to the surface 1214 between the supplementary pad 1211*b* and the upper layer pad 1210) of the supplementary pad 1211*b* of FIG. 12B, the lower layer pad is formed to expose at least a portion of the opening 1212 of the supplementary pad 1211*b*. For example, the opening 528 (FIG. 5) may be aligned with the opening 1212. According to the example embodiment, light applied to detect a polishing endpoint may reach the substrate through the opening 1212 and the window 1230.

According to some example embodiments, the supplementary pad may be formed on the surface of the upper layer pad after the window is removed from the used upper layer pad.

Figure 13A:
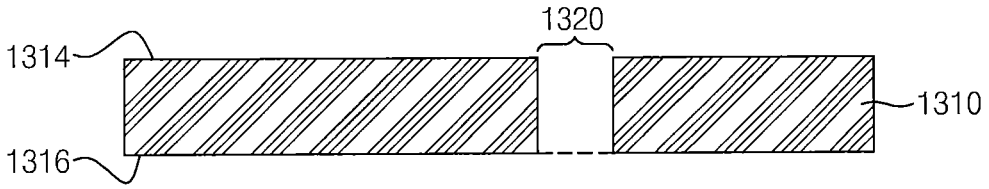
Figure 13B:
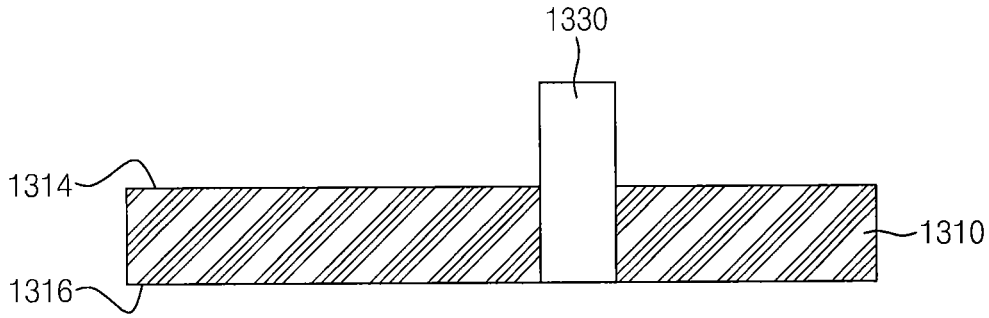
Figure 13C:
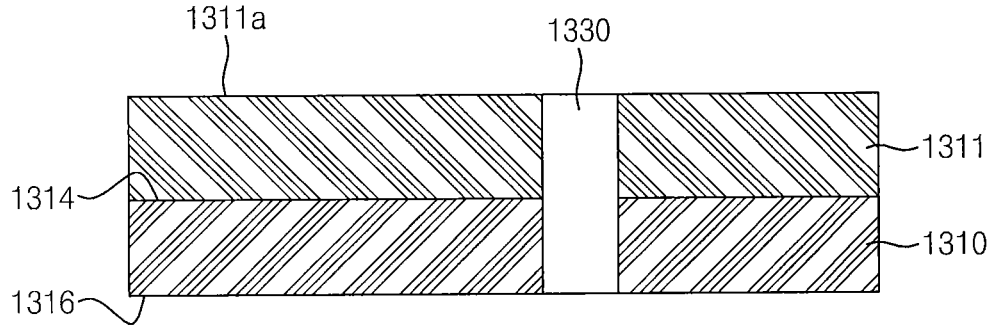

Referring to FIGS. 13A to 13C, the existing window 1230 which was previously disposed in the upper layer pad 1310 may be removed and a new window 1330 may be located at a portion or space 1320 in which the existing window 1230 is removed. For example, a height of the new window 1330 may be a distance at least from a bottom surface 1316 of the upper layer pad 1310 to a level at which a supplemental pad or supplementary pad 1311 is formed. The supplementary pad 1311 may be formed from one surface 1314 of the upper layer pad 1310 to at least the height of the new window 1330. For example, the upper layer pad 1310 and the new window 1330 may be located in the mold, as shown in FIG. 13B, and the supplementary pad 1311 may be formed on the remaining portion of the surface 1314 excluding the new window 1330. The new window 1330 extends to pass through the upper layer pad 1310 and the supplementary pad 1311.

According to the example embodiment, the new window 1330 is included in a polymer matrix which is used to form the pad structure of FIG. 13C so that the new window 1330 is integrated with the pad structure. In some example embodiments, when the lower layer pad is attached onto the exposed surface (or the surface opposite to the surface 1314 between the supplementary pad 1311 and the upper layer pad 1310) of the supplementary pad 1311 of FIG. 13C, the lower layer pad is formed to expose at least a portion of the new window 1330. For example, the lower layer pad may be formed to expose a surface of the new window 1330 which forms a continuous or substantially continuous surface with the surface 1311*a* of the supplementary pad 1311 opposite to the surface 1314. For example, the opening 528 (FIG. 5) may be aligned with the window 1330. The new grooves may be formed on the bottom surface 1316 of the upper layer pad 1310, which is opposite the surface 1314.

Figure 14A:
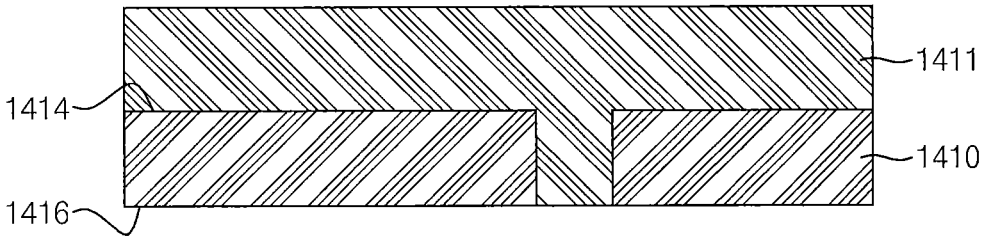
Figure 14B:
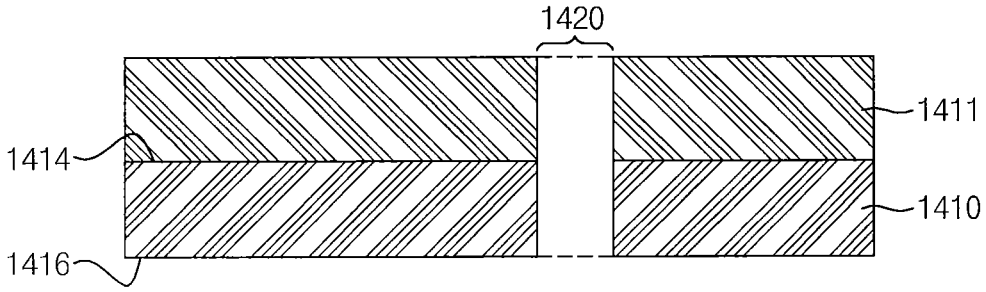
Figure 14C:
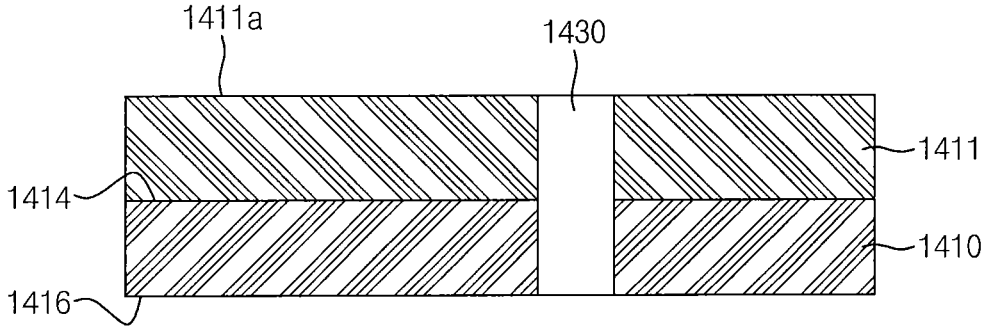

Referring to FIGS. 14A to 14C, in some example embodiments, a supplemental pad or supplementary pad 1411 may be formed on one surface 1414 of an upper layer pad 1410 while filling a portion or space (e.g., the portion 1320 of FIG. 13A) in which a window, which was previously disposed in the upper layer pad 1410, is removed. After an opening 1420 passing through the upper layer pad 1410 and the supplementary pad 1411 is formed, a new window 1430 may be inserted into the opening 1420. For example, the inserted window 1430 may have a height substantially equal to a total thickness of a pad structure of FIG. 14C. In some example embodiments, a lower layer pad through which at least a portion of the new window 1430 is exposed may also be attached onto the exposed surface of the supplementary pad 1411 of FIG. 14C. For example, a surface of the new window 1430 which forms a continuous or substantially continuous surface with a surface 1411*a* of the supplementary pad 1411, which is opposite the surface 1414, may be exposed through the lower layer pad. For example, the opening 528 (FIG. 5) may be aligned with the window 1430. The new grooves may be formed on one surface 1416 of the upper layer pad 1410, which is opposite the surface 1414.

In some example embodiments, as shown in FIG. 14A, after the supplementary pad 1411 is formed to fill the portion in which the existing window is removed, the new window may not be inserted. In this case, the supplementary pad 1411 extends to pass through the upper layer pad 1410. New grooves may be formed in the bottom surface 1316 of the pad structure of FIG. 13A or in the bottom surface 1416 of the pad structure of FIG. 14A without the insertion of the new window so that a windowless recycled polishing pad may be generated.

The new windows 1330 and 1430 of FIGS. 13B, 13C, and 14C may be made of a material having high light transmittance. For example, the new windows 1330 and 1430 may be a polymeric resin having light transmittance of about 1% or more. The new windows 1330 and 1430 may be transparent.

Figure 15:
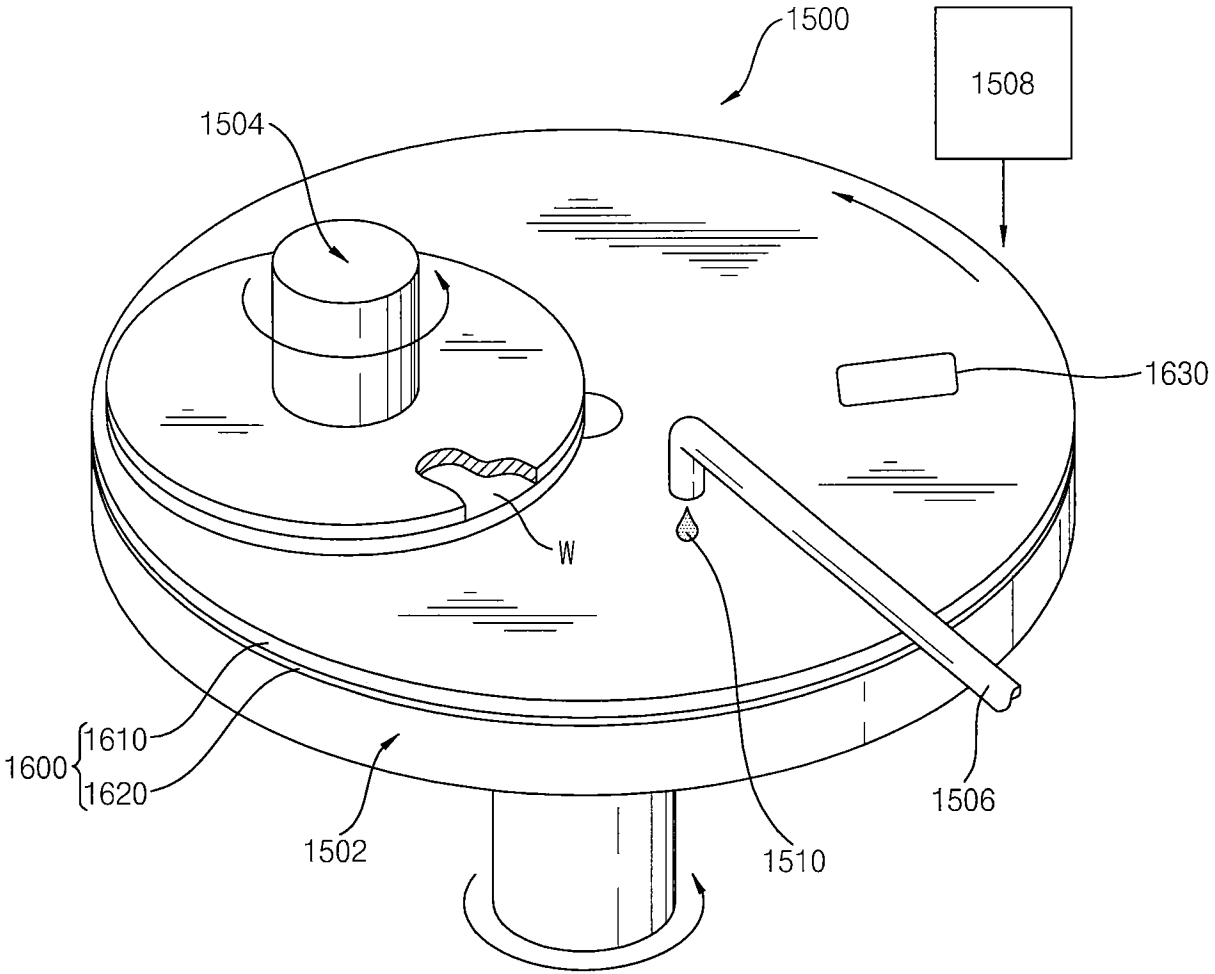
FIG. 15 is a partially cutaway perspective view schematically showing a major portion of a polishing apparatus for polishing a substrate using a recycled polishing pad according to an example embodiment of the inventive concept.

FIG. 15 is a partially cutaway perspective view schematically showing a major portion of a polishing apparatus 1500 for polishing a substrate using a recycled polishing pad 1600 according to an example embodiment of the inventive concept. In FIG. 15, a rotary type polishing apparatus 1500 is illustrated, but the inventive concept is not limited thereto.

Referring to FIG. 15, the polishing apparatus 1500 includes a plate or platen 1502, a head 1504, and a nozzle 1506. An upper surface of the platen 1502 may be used to support the polishing pad 1600. The head 1504 presses the polishing pad 1600 and a substrate W and rotates during polishing. The nozzle 1506 provides slurry 1510 to a polishing layer 1610 of the polishing pad 1600 during the polishing. The polishing apparatus 1500 may further include a conditioning unit 1508. The conditioning unit 1508 includes a diamond tip for conditioning the polishing pad 1600.

The polishing pad 1600 includes the polishing layer 1610. The polishing layer 1610 includes a used upper layer pad and a supplemental pad or supplementary pad according to various embodiments of the inventive concept. The polishing pad 1600 may further include a support layer 1620. The support layer 1620 may serve to support the polishing pad 1600 to be attached to the platen 1502 of the polishing apparatus 1500. In some example embodiments, the support layer 1620 may be omitted. In some example embodiments, the polishing pad 1600 may include a window 1630 for performing optical endpoint detection during the polishing process. The substrate W may be polished using a polishing target and may be loaded on the head 1504 opposite to the platen 1502 and brought into direct contact with the polishing layer 1610.

In FIG. 15, the case in which the polishing pad 1600 has a circular planar shape is illustrated. However, the shape of the polishing pad 1600 may be modified into various shapes such as a rectangular shape, a square shape, and the like according to the shape of the polishing apparatus 1500.

Figure 16:
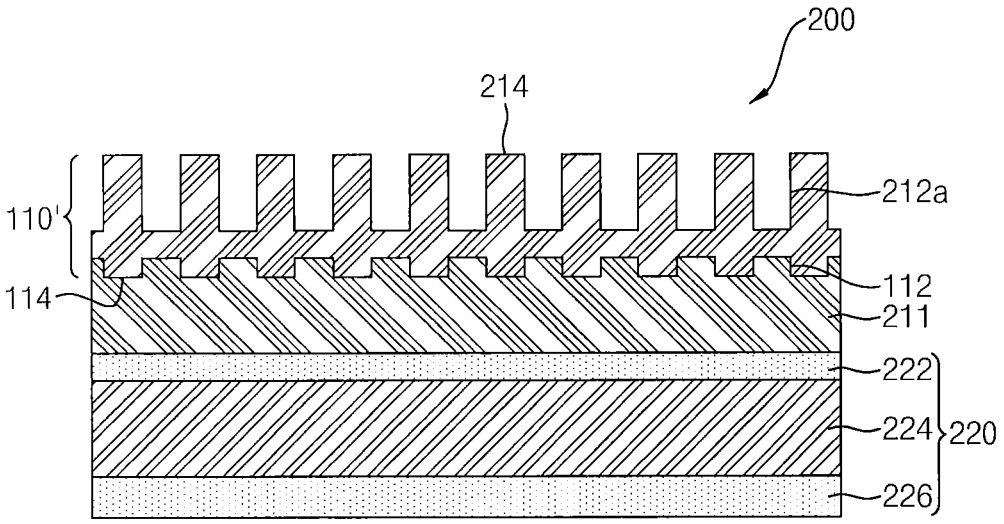
FIGS. 16 to 19 are cross-sectional views showing a portion of a recycled polishing pad according to example embodiments of the inventive concept.

FIGS. 16 to 19 are cross-sectional views showing a portion of a recycled polishing pad according to example embodiments of the inventive concept. Referring to FIG. 16, an upper layer pad 110' of a recycled polishing pad 200 includes a second surface 214 having second grooves 212*a*. The second grooves 212*a* may be disposed to be substantially aligned with first grooves 112. The second grooves 212*a* may be formed to have the same pattern as the first grooves 112. For example, the second grooves 212*a* may have the same width as the first grooves 112 and may be disposed at equal intervals.

Figure 17:
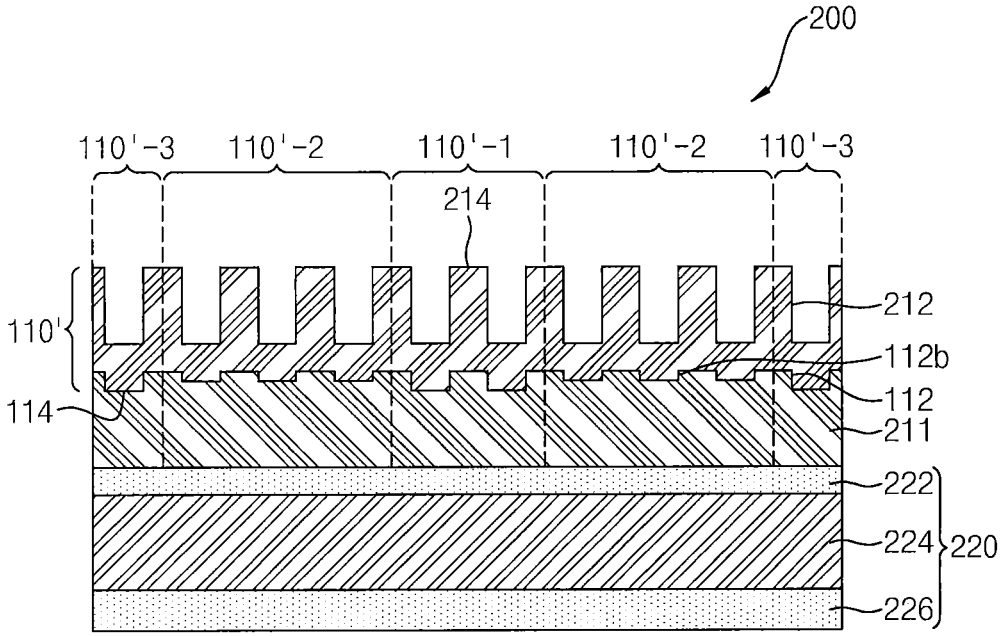

Referring to FIG. 17, an upper layer pad 110' of a recycled polishing pad 200 may be divided into a central portion 110'-1, an intermediate portion 110'-2, and a perimeter portion 110'-3. Referring to FIG. 15, the substrate W may be polished on the polishing pad 1600. For example, the substrate W may be polished between the center and the perimeter of the polishing pad 1600. Therefore, a surface of the polishing pad 1600 may be relatively less polished at the center and the perimeter thereof.

Referring again to FIG. 17, a first surface 114 worn during a polishing process may include first grooves 112 and second grooves 112*b*. The first surface 114 may be more worn at the intermediate portion 110'-2 than the central portion 110'-1 and the perimeter portion 110'-3. The first grooves 112 may be formed in the central portion 110'-1 and the perimeter portion 110'-3, and the second grooves 112*b* may be formed in the central portion 110'-1. A depth of each of the second grooves 112*b* may be less than a depth of each of the first grooves 112.

Figure 18:
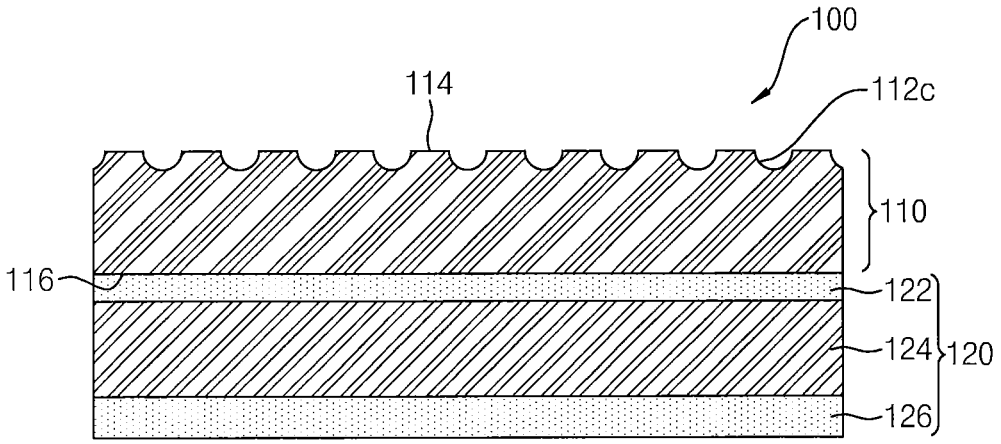

Referring to FIG. 18, a first surface 114 of an upper layer pad 110 includes first grooves 112*c*. The first grooves 112*c* may have a round shape. For example, the first grooves 112*c* may have a sloped side surface and a curved bottom surface. In addition, the first grooves 112*c* may have a tapered shape. For example, a width of each of the first grooves 112*c* may be reduced from the first surface 114 toward an inner portion or side of a polishing pad 100.

Figure 19:
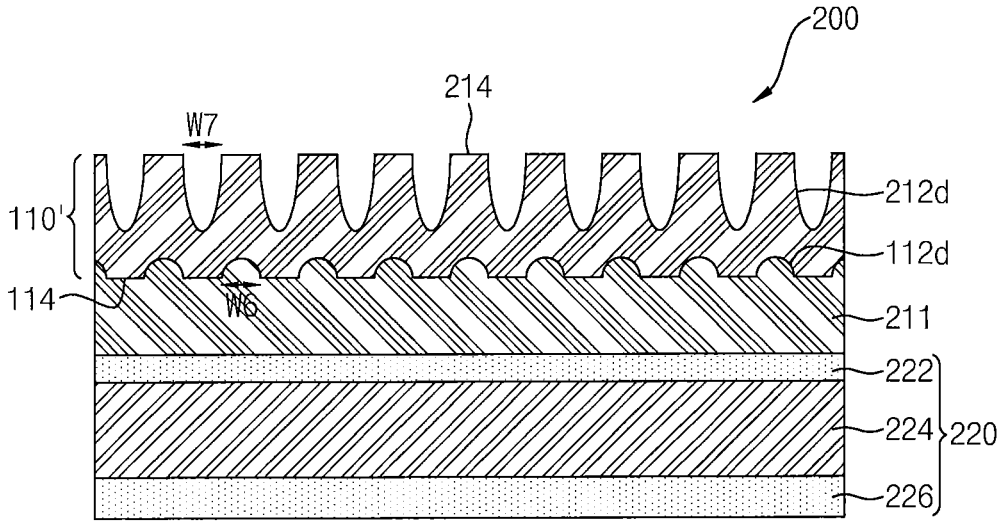

Referring to FIG. 19, a first surface 114 of an upper layer pad 110' includes first grooves 112*d*, and a second surface 214 of the upper layer pad 110' includes second grooves 212*d*. The first grooves 112*d* and the second grooves 212*d* may have a round shape. For example, the first grooves 112*d* and the second grooves 212*d* may have a curved bottom surface. The second grooves 212*d* may be formed to have a pattern different from that of the first grooves 112*d*. For example, a width W6 of each of the first grooves 112*d* in the first surface 114 may be less than a width W7 of each of the second grooves 212*d* in the second surface 214. Here, the width W6 refers to a horizontal width of each of the first grooves 112*d* in the first surface 114, and the width W7 refers to a horizontal width of each of the second grooves 212*d* in the second surface 214. Further, even when the first grooves 112*d* and the second grooves 212*d* are formed to have the same pattern as each other, each first groove 112*d* and each second groove 212*d* have a tapered shape, and thus the widths of the first grooves 112*d* and the second grooves 212*d* may be reduced as each of the first surface 114 and the second surface 214 is worn.

According to the example embodiments of the inventive concept, a supplemental pad or supplementary pad which supplements a worn portion of a worn polishing surface can be provided, and thus a polishing pad can be efficiently recycled. In addition, according to the example embodiments of the inventive concept, new grooves can be formed in a polishing pad in which a supplemental pad or supplementary pad is provided, and thus a recycled polishing pad can have substantially the same performance as that of the polishing pad before use.

While the embodiments of the inventive concept have been described with reference to the accompanying drawings, it should be understood by those skilled in the art that various modifications may be made without departing from the scope of the inventive concept and without changing essential features thereof. Therefore, the above-described embodiments should be considered in a descriptive sense only and not for purposes of limitation.

What is claimed is:

1. A recycled polishing pad comprising:

an upper layer pad from a worn polishing pad, the upper layer pad comprising a first surface having a plurality of first grooves, a second surface having a plurality of second grooves and being opposite to the first surface, and a connecting body connecting the plurality of first grooves and the plurality of second grooves; and a supplementary pad bonded to the first surface of the upper layer pad, wherein a depth of each of the plurality of first grooves has been reduced from a previous polishing process and is less than a depth of each of the plurality of second grooves.

2. The recycled polishing pad of claim 1, wherein a thickness ratio of the upper layer pad to the supplementary pad ranges from about 4:4 to 7:1.

3. The recycled polishing pad of claim 1, further comprising a window in the upper layer pad.

4. The recycled polishing pad of claim 3, wherein the supplementary pad is in direct contact with at least one surface of the window and the window and the first surface of the upper layer pad define a substantially continuous surface.

5. The recycled polishing pad of claim 3, wherein the supplementary pad has an opening in communication with the window.

6. The recycled polishing pad of claim 3, wherein:

the window extends through the upper layer pad and the supplementary pad; and a surface of the window and an at least partially exposed surface of the supplementary pad, which is opposite the first surface, define a substantially continuous surface.

7. The recycled polishing pad of claim 1, wherein the supplementary pad extends through the upper layer pad.

8. The recycled polishing pad of claim 1, wherein the plurality of first grooves and the plurality of second grooves are rectangular.

9. The recycled polishing pad of claim 1, wherein the plurality of first grooves and the plurality of second grooves are misaligned with each other.

10. The recycled polishing pad of claim 1, wherein a horizontal width of each of the plurality of first grooves is different from a horizontal width of each of the plurality of second grooves.

11. The recycled polishing pad of claim 1, wherein an interval between adjacent ones of the plurality of first grooves is different from an interval between adjacent ones of the plurality of second grooves.

12. The recycled polishing pad of claim 1, wherein a depth of each of the first grooves at an intermediate portion of the upper layer pad is less than a depth of each of the first grooves at a central portion and a perimeter portion of the upper layer pad, and wherein the intermediate portion of the upper layer pad is between the central portion and the perimeter portion of the upper layer pad.

13. The recycled polishing pad of claim 1, wherein portions of the supplementary pad fill inner volumes of the plurality of first grooves.

14. A recycled polishing pad comprising:

an upper layer pad from a worn polishing pad, the upper layer pad comprising a first surface having a plurality of first grooves, a second surface having a plurality of second grooves and being opposite to the first surface, and a connecting body connecting the first surface and the second surface; and a supplementary pad bonded to the first surface of the upper layer pad, wherein a depth of each of the plurality of first grooves has been reduced from a previous polishing process and is less than a depth of each of the plurality of second grooves, the plurality of first grooves and the plurality of second grooves have a round shape.

15. The recycled polishing pad of claim 14, wherein:

a width of each of the plurality of first grooves decreases from the first surface toward the connecting body; and a width of each of the plurality of second grooves decreases from the second surface toward the connecting body.

16. The recycled polishing pad of claim 14, wherein a width of each of the plurality of first grooves is less than a width of each of the plurality of second grooves.

17. The recycled polishing pad of claim 14, wherein the plurality of first grooves and the plurality of second grooves are misaligned with each other.

18. A recycled polishing pad comprising:

an upper layer pad from a worn polishing pad, the upper layer pad comprising a first surface having a plurality of first grooves, a second surface having a plurality of second grooves and being opposite to the first surface, and a connecting body connecting the plurality of first grooves and the plurality of second grooves;

a supplementary pad below the upper layer pad and in contact with the first surface; and a lower layer pad below the supplementary pad, wherein a depth of each of the first grooves has been reduced from a previous polishing process and is less than a depth of each of the second grooves.

19. The recycled polishing pad of claim 18, further comprising a first adhesive layer between the supplementary pad and the lower layer pad.

20. The recycled polishing pad of claim 18, further comprising a second adhesive layer below the lower layer pad.

* * * * *